US005086934A

United States Patent [19]

Kelly

[11] Patent Number: 5,086,934

[45] Date of Patent: Feb. 11, 1992

[54] RADIOGRAPHIC FILE HOLDER

[76] Inventor: John K. Kelly, 2293 Rio de Janeiro Ave., Punta Gorda, Fla. 33983

[21] Appl. No.: 624,573

[22] Filed: Dec. 10, 1990

[51] Int. Cl.[5] ..... A47F 5/00

[52] U.S. Cl. ..... 211/45

[58] Field of Search ..... 211/45, 46, 60.1; 312/184

[56] References Cited

U.S. PATENT DOCUMENTS

| | | | |
|---|---|---|---|
| 1,524,348 | 1/1925 | Field | 211/46 |
| 2,174,201 | 9/1939 | Chauvin | 211/46 |
| 2,318,077 | 5/1943 | Jonas | 211/46 |
| 2,948,402 | 8/1960 | Patterson | 312/184 X |
| 3,365,259 | 1/1968 | Heisman et al. | 312/194 |
| 3,472,387 | 10/1969 | Olsen . | |
| 3,642,338 | 2/1972 | Humphrey | 312/184 |
| 3,885,726 | 5/1975 | Fridlund et al. | 312/184 X |
| 4,527,694 | 7/1985 | Bolt et al. | 211/45 X |
| 4,960,211 | 10/1990 | Bailey | 211/60.1 |

*Primary Examiner*—Robert W. Gibson, Jr.
*Attorney, Agent, or Firm*—Frank A. Lukasik

[57] ABSTRACT

A radiographic film record holder comprising a wheel-bearing supporting base, hanging bars supported on said base, and a continuous flexible strip having pockets formed across the width thereof supported by metal flat bars inserted into said pockets, mated with opposing holes in said hanging bars, and forming a series of downwardly hanging, flexible strip, film record holder slots.

4 Claims, 2 Drawing Sheets

RADIOGRAPHIC FILE HOLDER

BACKGROUND OF THE INVENTION

1. Field of the Invention

This invention relates to a file holder for temporary storage of X-Ray film for examination by a doctor or medical technician.

2. Description of the Prior Art

There are several prior art portable chart holders. For example, U.S. Pat. No. 1,312,306 discloses a space saver chart desk having a chart file in a drawer in the desk and adapted to be moved readily to concealed position or exposed position without requiring the removal of the files. One side of the drawer is higher than the other so that the chart holders with charts are supported in stepped formation. U.S. Pat. No. 3,472,387 discloses a hospital record chart holder apparatus which includes a wheel-bearing frame suspended vertically. To prevent the hospital record chart holders from swinging on their supporting shaft or pintles and clashing into contact with each other, stationary resilient snubber bar members are mounted on the supporting frame at the outer sides of the record chart holders.

In addition to the above cited patents, several film and cassette carts are available on the commercial market. Among some of the available carts, there are two tier carts for storage capacity, three tier cassette with tilted shelves to keep cassettes in place and Eldon Hot Files (R) floor stands which can be used for display in offices, lobbies showrooms or any work environment.

None of the above cited references are used nor can they be used to to hold radiographic files nor do they require the support and care that the medical records require.

SUMMARY OF THE INVENTION

The principle utility of the invention is as a work holder for temporary storage of X-Ray film for examination by a doctor or medical technician. More specifically, this invention aids in the management of radiographic folders in the radiology department.

It is therefore an object of the invention to provide a new and improved portable wheel-bearing radiographic film record holder.

It is another object of the invention to provide a radiographic film record holder which also serves as a temporary storage area for easy access by a doctor or medical technician.

A still further object of the invention is to provide a temporary storage area for holding radiographic film folders in a vertical, stepped relationship to provide rapid and convenient visual access to identifying features.

These and other objects of the invention will become apparent to those skilled in the art to which the invention pertains when taken in light of the annexed drawings.

DESCRIPTION OF THE PREFERRED EMBODIMENT

Figure 1:
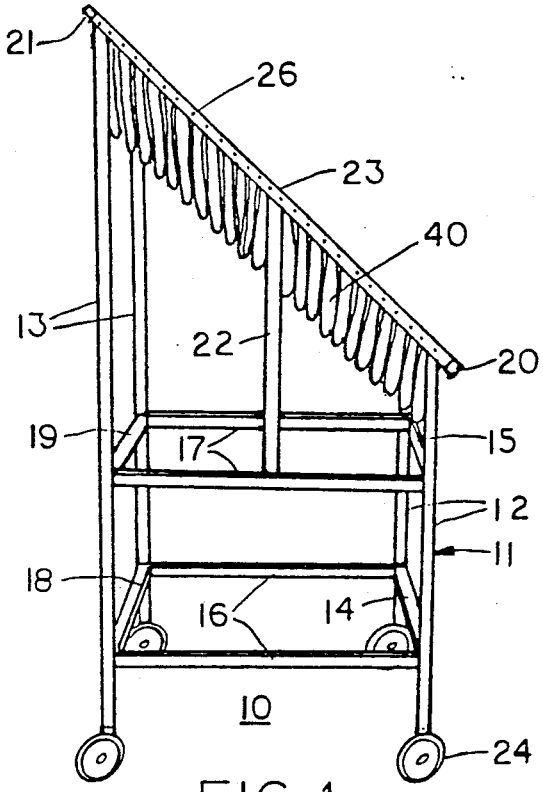
FIG. 1 is a perspective view of a portable wheel-bearing radiographic film record holder embodying the present invention.
Figure 2:
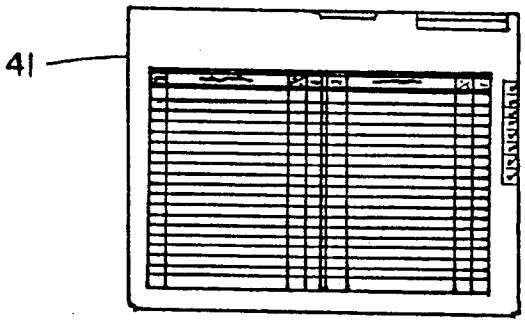
FIG. 2 is a front view of a radiographic film record.

A preferred embodiment of the new radiographic film record holder is shown in the drawings, wherein it is generally indicated at 10 and comprises a base 11 which includes vertical front corner posts 12 and rear corner posts 13 which are longer than front corner posts 12, a lower front horizontal bar 14, upper front horizontal bar 15, lower side horizontal bars 16, upper side horizontal bars 17, rear lower horizontal bar 18, rear upper horizontal bar 19, front frame bar 20, rear frame bar 21, vertical support bars 22, hanging bars 23, casters 24, and continuous canvas strip 25. All of the parts of the supporting frame, base 11, described above, may be made of any suitable material such as, for example, wood, aluminum, or chromium-plated steel tubular material. The various parts of base 11 may be fastened together by welding, gluing or with screws dependent upon the material selected for the base 11.

Figure 6:
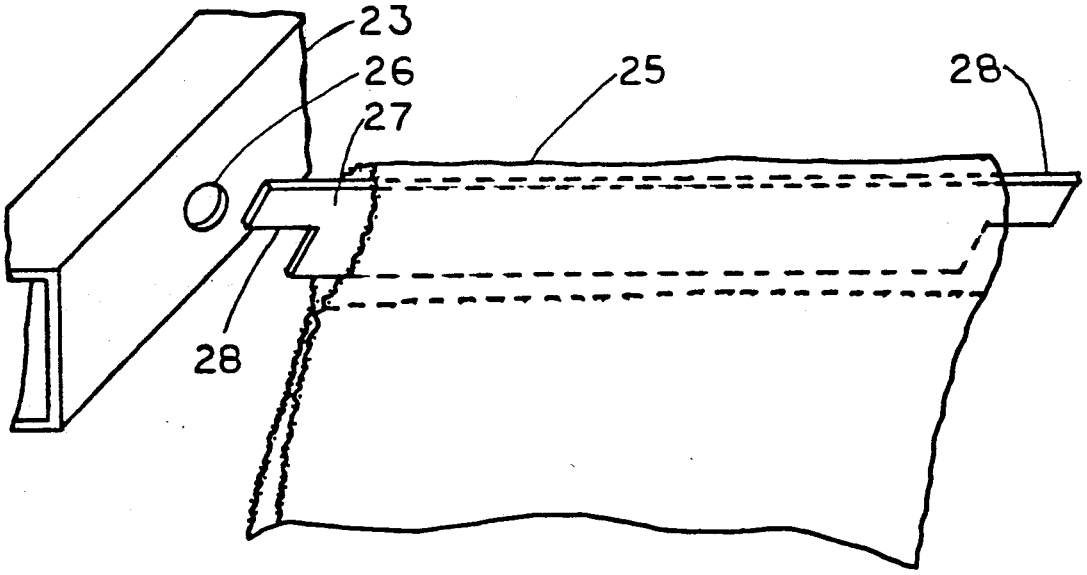
FIG. 6 is a perspective view, partially in section, of a rod assembled in a pocket.

A pair of hanging bars 23 are arranged at opposite sides of the supporting frame at an angle of 45° to base 11, and extend angularly upwardwardly from the front frame bar 20, to the rear frame bar 21. Each of the hanging bars 23 is generally rectangular shaped, tubular aluminum and bearing holes 26 formed in each of the hanging bars 23 at spaced intervals longitudinally. In a preferred embodiment, the distance between the holes 26 along the inside of hanging bars 23 may be 1½"–1182". The holes 26 may also be drilled through the outside of hanging bars 23 to permit fastening of flat bars 27 or round bars (not shown) with screws if desired. As shown in FIG. 6, flat bars 27 are formed with pivot ends 28 at each end to be inserted in holes 26 of hanging bars 23. As an example of the preferred embodiment, flat bars 27 may be made from ⅛" thick ×½" wide and 20–24" long steel.

Figure 4:
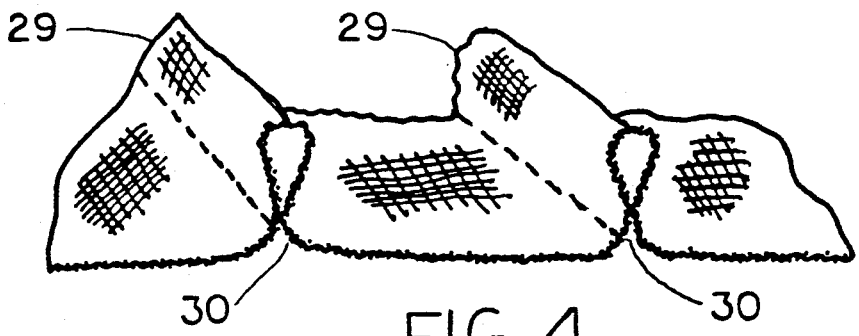
FIG. 4 is a fragmentary side sectional view of a continuous canvas strip showing the formed pockets.
Figure 5:
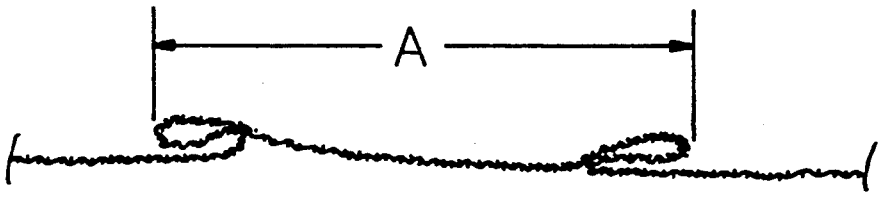
FIG. 5 is a side view of a section of a continuous canvas strip showing dimension A.

Referring to FIGS. 4 and 5, continuous canvas strip 25 is formed into pockets 29 by joining the material at seam 30 by stitching, fastening with Velcro strips or other methods of joining fabric. In a preferred embodiment, the dimension "A" of FIG. 5 was 18" and sufficient pockets 29 may be formed to provide 22 to 26 slots 40 to hold at least 22 radiographic film records 41. An appropriate number of flat bars 27 are assembled into pockets 29, and pivot ends 28 are inserted into appropriate holes 26 located in hanging bars 23. When fully assembled, the radiographic film record holder 10 is capable of holding at least 26 film records 41. Shelves 43 may be provided for convenience. One example of a radiographic film record 41 is a "Color Coded X-Ray Envelope" 66276X, manufactured by Visible Record Equipment Company, Malvern, Ohio 44644.

OPERATION

Figure 3:
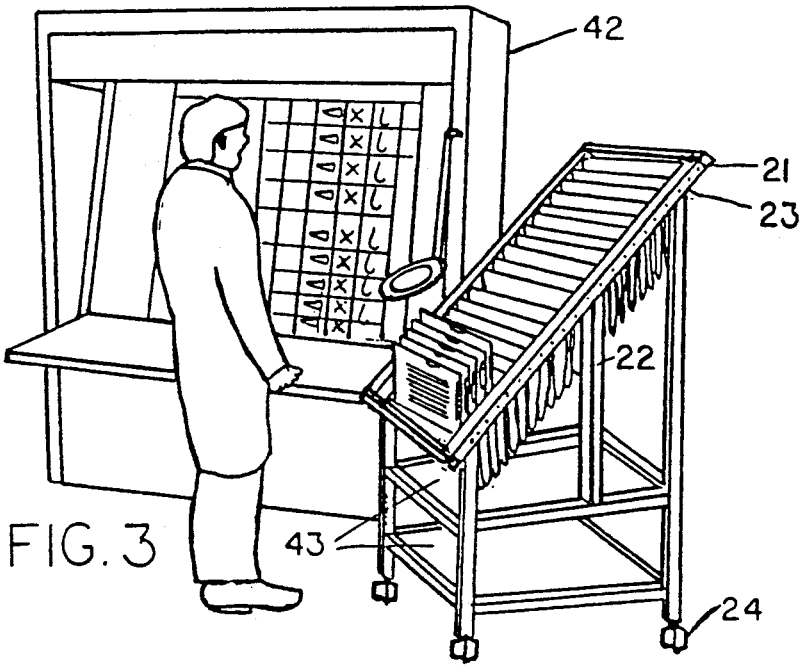
FIG. 3 is a perspective view of a radiographic film record holder embodying the present invention located in a common reading area.

As the X-Ray film is completed, it is identified, and placed in an appropriate film record 41, and marked with the patient's name, identifying number, and other pertinent information. When the collection is completed, the portable wheel-bearing radiographic film holder is rolled into the examining area and may be conveniently be located next to a viewing screen 42 in a common reading or reporting area such as shown in FIG. 3. The invention aids in the arrangement of radiographic folders in the radiology departments. It helps to assist in the moving of heavy stacks of folders from the folder assembly area to the doctor's offices or to the common reading area. Furthermore, the invention eliminates stacks of folders in the department, assists with filing the jacket after completion of the typed report, makes it easier to insert the report in the jacket because the jacket is already in the vertical position and when a physician comes into the department requesting a particular patient's folder, instead of thumbing through the stacks, the folder names are visually accessible at a glance. During the doctor's dictation of current films, he or she may want to access previous studies for comparison. With the invention, the doctor will have quick localization of the folder and accessibility of previous studies due to the folder being in a vertical position.

While the invention has been explained with respect to a preferred embodiment thereof, it is contemplated that various changes may be made in the invention without departing from the spirit and scope thereof.

What is claimed is:

1. A new and improved portable, radiographic film record holder comprising:

a wheel-bearing supporting base having, front corner posts, rear corner posts and side vertical posts, said rear corner and vertical posts being longer than said front corner posts, a pair of hanging bars supported on the top edges of said front, rear and vertical posts and forming an inclined plane extending upwardly from said front corner posts to said rear corner posts, said hanging bars having a plurality of equally spaced apart holes formed therein, and means supported by said hanging bars for removably supporting a plurality of said records in a stepped relationship, said means comprising a continuous flexible strip having:

a plurality of equally spaced apart pockets formed across the width of said flexible strip and along the entire length of said flexible strip, and a plurality of bar means inserted into said pockets and fixedly mated with said holes in said hanging bars and forming a series of downwardly hanging, equally spaced, stepped, flexible, film record holder slots.

2. A new and improved portable, radiographic film record holder as claimed in claim 1 wherein said continuous flexible strip consists of cotton canvas and said bar means comprises flat bars having reduced size end sections.

3. A new and improved portable, radiographic film record holder as claimed in claim 1 wherein said continuous flexible strip consists of a synthetic material.

4. A new and improved portable, radiographic film record holder comprising:

a wheel-bearing supporting base, having front corner posts, rear corner posts and side vertical posts, said rear corner and vertical posts being longer than said front corner posts, a pair of hanging bars supported on the top edges of said front, rear and vertical posts and forming an inclined plane extending upwardly from said front corner posts to said rear corner posts, said hanging bars having a plurality of equally spaced apart holes formed therein, a continuous cotton canvas strip having a plurality of equally spaced apart pockets formed across the width and along the entire length of said strip, and a plurality of metal bars, each having reduced size end sections, inserted into said pockets, and said reduced size end sections being fixedly mated with said holes in said hanging bars and forming a series of downwardly hanging, equally spaced, stepped, canvas, film record holder slots.

* * * * *